United States Patent [19]

Sjodahl

[11] Patent Number: 4,724,894

[45] Date of Patent: Feb. 16, 1988

[54] MOLTEN METAL POUR CONTROL SYSTEM

[75] Inventor: Eric J. Sjodahl, Valdese, N.C.

[73] Assignee: Selective Electronic, Inc., Valdese, N.C.

[21] Appl. No.: 934,630

[22] Filed: Nov. 25, 1986

[51] Int. Cl.[4] ..... B22D 39/00; B22D 46/00

[52] U.S. Cl. ..... 164/457; 164/155

[58] Field of Search ..... 164/4.1, 150, 154, 155, 164/456, 457

[56] References Cited

U.S. PATENT DOCUMENTS

| | | | |
|---|---|---|---|
| 3,565,531 | 2/1971 | Kane et al. | 356/381 |
| 3,633,010 | 1/1972 | Svetlichny | 364/506 |
| 4,033,403 | 7/1977 | Seaton et al. | 164/155 |
| 4,276,921 | 7/1981 | Lemmens et al. | 164/453 |
| 4,279,290 | 7/1981 | Mikami et al. | 164/154 |
| 4,375,921 | 3/1983 | Morander | 356/381 |
| 4,453,083 | 6/1984 | Bohlander et al. | 250/561 |
| 4,508,970 | 4/1985 | Ackerman | 250/577 |

FOREIGN PATENT DOCUMENTS

| | | | |
|---|---|---|---|
| 55-133865 | 10/1980 | Japan | 164/154 |
| 58-81551 | 5/1983 | Japan | 164/457 |
| 60-154866 | 8/1985 | Japan | 164/457 |

OTHER PUBLICATIONS

Modern Casting, "Central Foundry Adapts Lasers to Foundry Operations", Mar. 1984.

*Primary Examiner*—Nicholas P. Godici

*Assistant Examiner*—Richard K. Seidel

*Attorney, Agent, or Firm*—Bell, Seltzer, Park & Gibson

[57] ABSTRACT

An apparatus and method for controlling the filling of mold sections with molten metal is disclosed. The apparatus and method utilize a mold making machine for forming mold sections having a recessed cup on its upper side, a hollow cavity in the interior thereof having a predetermined shape and a passageway interconnecting the hollow cavity and the recessed cup, a conveyor for transporting the mold sections along a predetermined path, a pour vessel including a discharge opening and a valve for controlling the pouring of molten metal from the vessel into the mold sections, a vessel-moving device for positioning the mold section beneath the discharge opening of the vessel, a distance measuring device located above the mold sections and oriented towards the mold sections and operable for measuring the distance to the molten metal level in the recessed cup, and a control device connected to the vessel-moving device, the distance measuring device and the valve of the vessel and operable during the transporting of the mold sections for determining the distance that the mold section has yet to travel and moving the vessel so as to position it directly over the final location of the mold section at the mold pouring station and for controlling during the pouring of the molten metal the operation of the valve in response to variations in the molten metal level so as to maintain a predetermined level of the molten metal during the filling operation.

36 Claims, 13 Drawing Figures

MOLTEN METAL POUR CONTROL SYSTEM

BACKGROUND OF THE INVENTION

This invention relates to an apparatus and method useful in foundry operations for positioning molds correctly with respect to a pouring vessel prior to filling the molds with molten metal from the pouring vessel. The invention also relates to an apparatus and method for controlling the pouring of the molten metal into the molds. Particularly, this invention relates to the use of a non-contact distance measuring device, located above the mold, in conjunction with a control system, to control the position of a pouring vessel over the mold for dispensing the molten metal, and also to control the pour rate from the vessel during the filling of the mold.

Typically in foundry operations, molds have been positioned and filled manually and with simple mechanical apparatus. For example, a series of sand molds formed by a mold making machine would be conveyed successively to a mold pouring station, where the operator would adjust the position of a filling vessel based upon a visual estimate as to when the vessel was positioned directly over the pour opening of the mold. Similarly, when pouring molten metal from the vessel, the operator would adjust the valve of the vessel and the flow rate of the molten metal according to what he believed from past knowledge and experience was the rate necessary to completely fill the mold cavity and produce an acceptable end product. As is readily apparent, this approach is largely dependent upon the skill of the operator.

The present invention eliminates much of this inaccuracy and human error by utilizing a non-contact distance measuring device and control system to automatically control the positioning of the dispensing vessel and the pouring of molten metal therefrom.

Non-contact distance measuring devices, such as devices utilizing lasers, have been employed in a variety of manufacturing and industrial applications. Laser measuring devices, for example, have been used for such diverse applications as measuring fluid levels in bottles, performing quality control of machine parts, measuring the thickness of steel slabs, and numerous other areas wherein the flucuation of the distance to the surface of an object as it passes beneath a laser beam can be measured and correlated to a desired property or dimension of that article.

Exemplary systems utilizing non-contact distance measuring devices in manufacturing applications are disclosed in U.S. Pat. No. 3,565,531 to Kane et al, U.S. Pat. No. 3,633,010 to Svetlichy, U.S. Pat. No. 4,375,921 to Morander and U.S. Pat. No. 4,453,083 to Bohlander et al. Examples of systems in the specific area of filling molds with molten metal include U.S. Pat. No. 4,276,921 to Lemmens et al, U.S. Pat. No. 4,508,970 to Ackerman and a *Modern Casting* article, "Central Foundry Adapts Lasers to Foundry Operations" (March 1984).

However, these systems have not utilized the distance measuring device acting cooperatively with a dispensing vessel to control the positioning of the dispensing vessel over the pour cup opening of the mold cavity nor do these systems control the rate of pouring from the dispensing vessel in response to variations in the molten metal level in the mold pour cup.

SUMMARY OF THE INVENTION

Generally, in a foundry it is critical that the mold which receives the molten metal be positioned correctly beneath the pouring vessel before each pour, and once the pour begins it is also important that the pour rate be controlled so as to properly fill the mold cavity. In accordance with the present invention, an apparatus and method for positioning and controlling the pour rate is provided.

The present invention is adapted for use in foundries in which a series of cooperating mold sections are sucessively formed by a mold making machine and are advanced to a pouring vessel for being filled with molten metal. The apparatus of the present invention utilizes a non-contact distance measuring device in conjunction with a system control unit to precisely position the pour cup opening of the mold directly below the pouring vessel prior to pouring. The same measuring device and control unit are utilized to monitor the level of molten metal in the pour cup of the mold and to control the pour rate into the mold based upon a predetermined, programmed pour rate.

Specifically, the apparatus and method of the present invention utilizes a mold making machine for forming a series of cooperating mold sections having a recessed pour cup on the upper side thereof adapted for receiving molten metal, a conveyor for directing the cooperating mold sections along a predetermined path to a pouring station, a pour vessel and a vessel-moving device located at the pouring station, a non-contact distance measuring device for locating the recessed pour cup in the mold sections, and a control system operable for determining the distance that the mold sections have yet to travel to the pouring station and for controlling the movement of the pour vessel so that the vessel will be located directly over the pour cup when the mold sections reach the pouring station.

Once the pour vessel has been properly positioned over the pour cup, the same non-contact distance measuring device is utilized during the pouring of molten metal into the mold for continuously measuring and monitoring the level of the molten metal in the pour cup and for controlling the rate of pour so as to maintain a predetermined level in the cup during the mold filling operation. This prevents undesired impurities from being drawn into the mold cavity, prevents erosion of sand from the mold due to improper pour rates, and prevents over or under filling of the mold.

DETAILED DESCRIPTION OF THE INVENTION

The present invention now will be described more fully hereinafter with reference to the accompanying drawings, in which preferred embodiments of the invention are shown. This invention can, however, be embodied in many different forms and should not be construed as limited to the embodiments set forth herein; rather, applicants provide these embodiments so that this disclosure will be thorough and complete, and will fully convey the scope of the invention to those skilled in the art.

Figure 1:
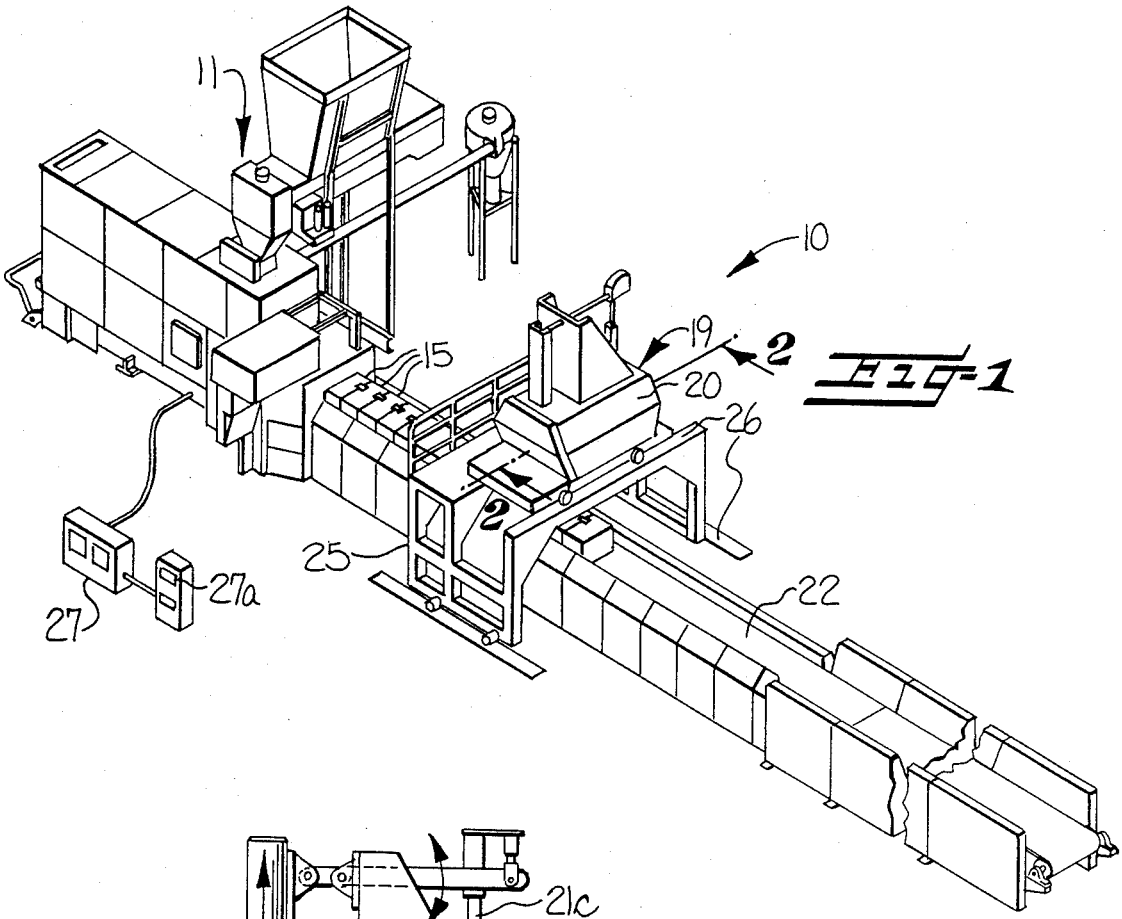
FIG. 1 is a perspective view of a foundry production line incorporating the mold positioning and filling system of the present invention.

FIG. 1 discloses the basic foundry production line system, generally indicated by the reference numeral 10, employed in the embodiments of the present invention. The basic system 10 is comprised of a mold making machine 11 for forming a series of cooperating mold sections 15, a conveyor 22, a mold pouring station 19, including a vessel 20 for dispensing molten metal and a vessel-moving device 25, and a system control unit 27 interconnected with the mold making machine 11, the vessel 20 and vessel-moving device 25. The mold sections 15 are formed by the mold making machine 11, conveyed in a series along a predetermined path to the mold pouring station 19, positioned by the system control unit 27 directly under the pour vessel 20, and then filled at a controlled rate. Turning now to the specific aspects of positioning and filling the mold sections, each will be discussed in detail hereinafter.

Figure 5:
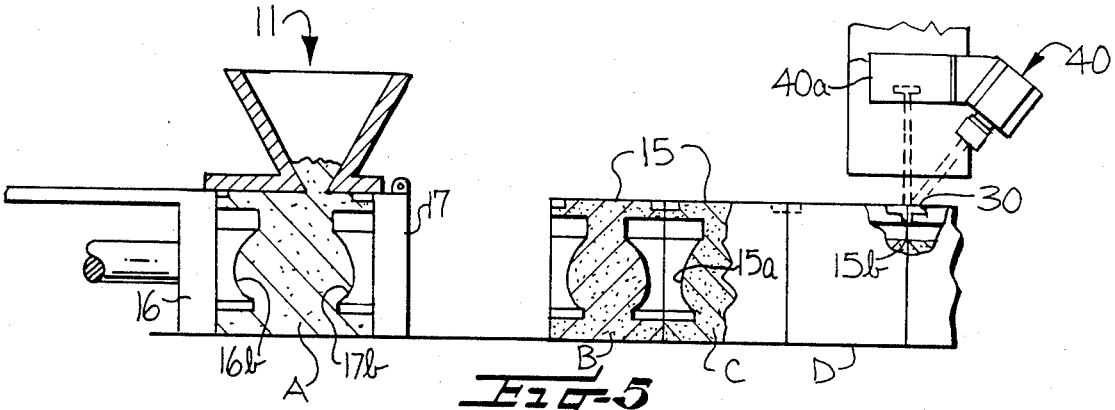
FIGS. 5–8 are sectional views showing a mold making machine at various stages of advancement of the mold sections from the mold making station to the mold pouring station.
Figure 6:
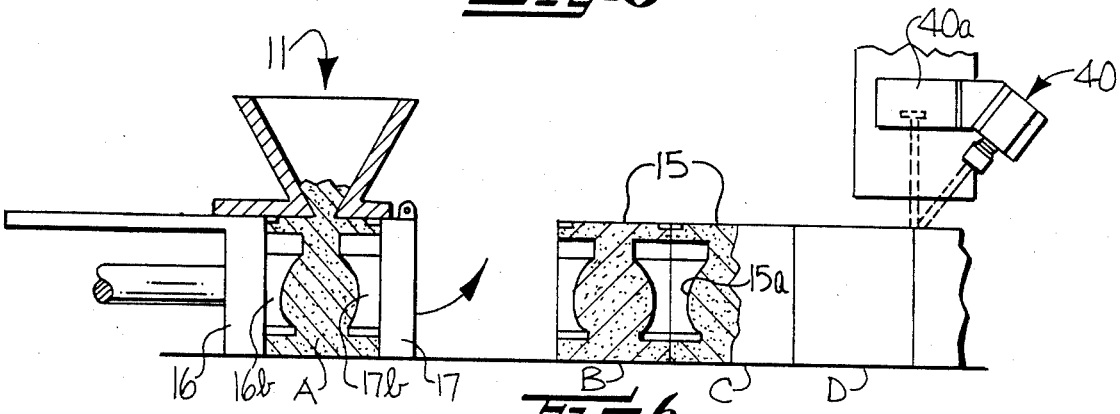
Figure 7:
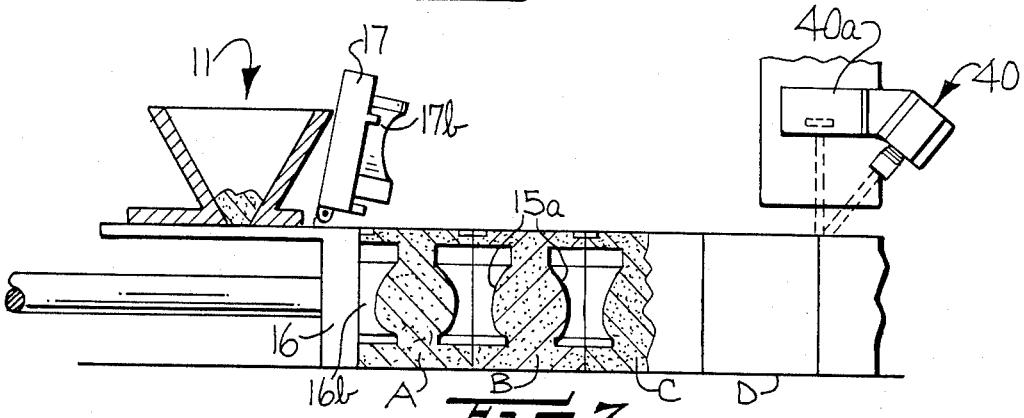

Referring now to FIGS. 1 and 5–8, the mold making machine 11 is a commercially available sand mold machine of the type commonly utilized by foundries, such as a ram-type or a carousel-type mold making machine. As shown in FIG. 5, sand is formed by a ram-type mold making machine into a series of mold sections 15 which cooperate to form a hollow internal cavity of the desired shape, such as an anvil shape as shown. The shape of the internal cavity is formed by a ram 16 carrying a mold die **16*b* impressing half of the desired shape into the trailing face of the mold section A and by an upwardly pivotable gate 17 also carrying a mold die 17*b* impressing the opposite half of the shape into the leading face of mold section A. Then the gate 17 is moved upwardly out of the way, and ram 16 pushes the newly formed mold section A forwardly out of the mold making machine as shown in FIGS. 6 and 7. The leading edge of mold section A comes in contact with trailing edge of mold section B, and the cooperating mold sections thus form a hollow cavity 15*a* of predetermined shape and a passageway 15*b* interconnecting the cavity 15*a* with a recessed pour cup or spure cup 30 on the upper side of the mold section 15. The recessed pour cup 30** is typically rectangular but can be any shape which is adapted for receiving the molten metal.

Located above the mold sections 15 at a predetermined location downstream from the mold forming machine is a non-contact distance measuring device 40. The non-contact distance measuring device 40 generally utilizes an infrared light source such as an LED or a laser diode to create an illuminated spot on a surface, herein the surface of the mold section 15 or the molten metal head level 45. An optical sensor **40*a* associated with the measuring device 40** detects the position of the spot on the surface and thereby measures the distance to the surface of the object. Laser non-contact distance measuring devices of this type are known in the art and available commercially. One such suitable device is the OPTOCATOR TM, available from Selective Electronic Inc. of Valdese, N.C.

Figure 2:
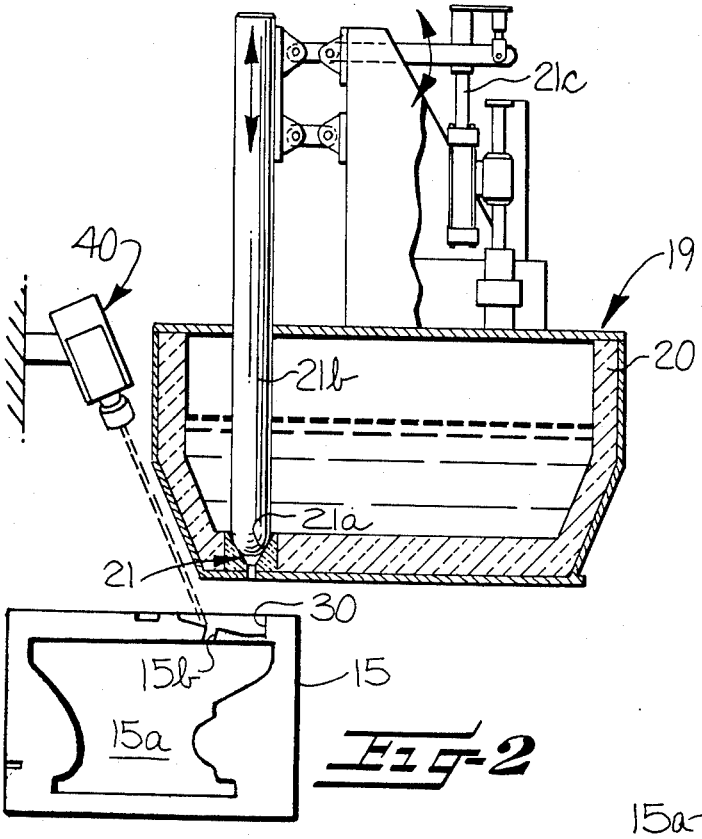
FIG. 2 is a sectional view taken substantially along line 2—2 of FIG. 1 and showing in detail a vessel for dispensing the molten metal, a non-contact distance measuring device and a mold section.

Acting cooperatively with the non-contact distance measuring device 40, is a vessel 20 for dispensing molten metal. The vessel 20 is located on a tram or track 26 shown in FIG. 1 so that the vessel can be easily moved both parallel and perpendicular to the path of the mold sections 15 by a vessel-moving device 25. The vessel 20 itself is any of the many molten metal pouring devices known in the art. Referring to FIG. 2, the vessel 20 includes a valve 21 for controlling the pour, wherein the valve 21 includes a valve seat **21*a* and a cooperating plunger or rod 21*b* and a device 21*c* for adjusting the rod 21*b* so as to control the opening and closing of the valve 21**.

Figure 12:
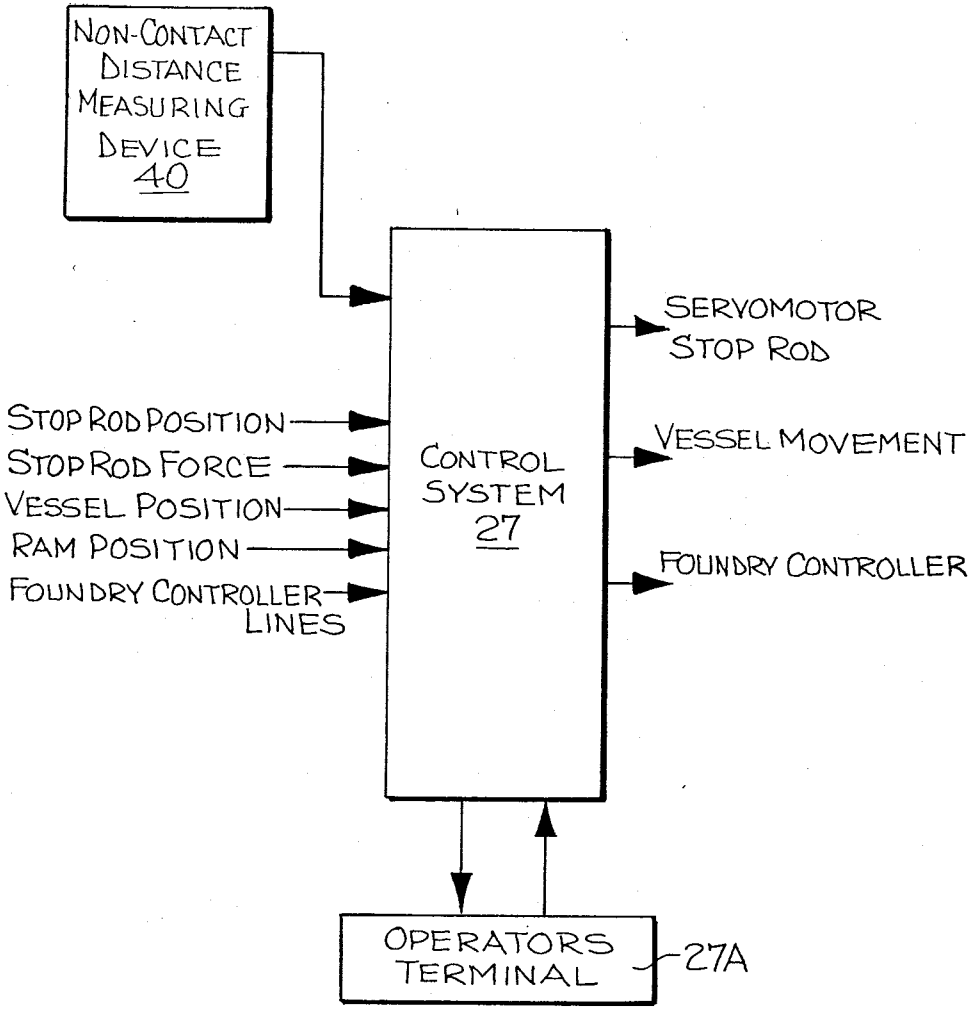
FIG. 12 is a schematic representation of the control system and functions performed thereby.

A system control unit 27 is connected to the distance measuring device 40 and the ram 16 and the pouring vessel 20. It is operable for sensing when and how far the ram 16 has moved and for controlling the movement of the vessel 20 by the vessel-moving device 25. It is also operable for opening and closing the valve 21 by controlling the movement of the rod **21*b* relative to the valve seat 21*a*. The system control unit 27 includes a microprocessor operating under program control for carrying out the aforementioned functions. As best seen in FIG. 12, an operator's terminal 27*a* is connected to the control unit 27 and enables the operator to input commands and data to the control unit 27 and to obtain a display of information concerning the operation of the system. As shown in FIG. 12, the control system 27 receives such input data as the position of vessel 20, the ram 16 position, the position and force of the vessel rod 21*b*, the distance data from the non-contact distance measuring device 40, and any input from the operator such as changes in the previously programmed graph of FIG. 10. The system control unit 27 can then control movement of the vessel 20 to the proper location and control the pour rate by sending output data to control the vessel-moving device 25 and the opening and closing of the valve 21**, respectively.

Vessel Positioning

The functions of the components of the apparatus 10 specifically with respect to positioning the vessel 20 over the mold section 15 will become more apparent from the following description in connection with FIGS. 5–8. The respective mold sections 15 are formed on each of the successive strokes of the ram 16 and are conveyed down a predetermined path of travel by the pushing of the ram 16 and the conveyor 22.

Figure 8:
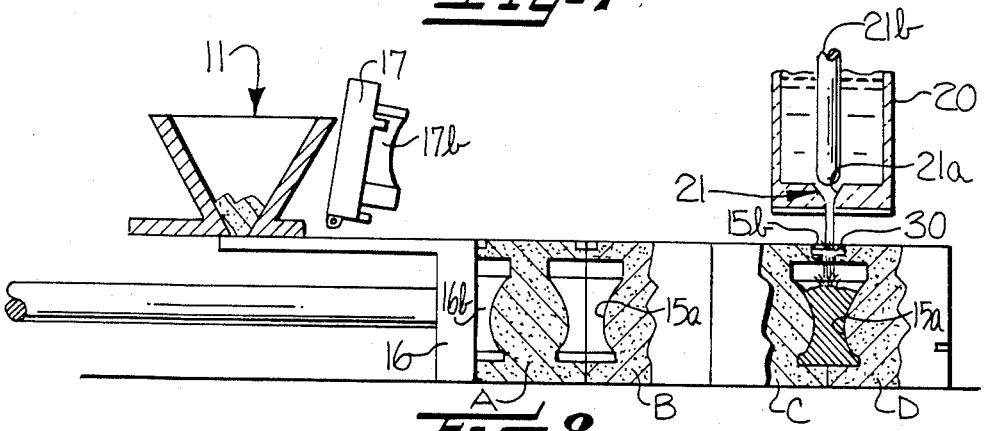

As shown in the left portion of FIG. 5, the ram 16 begins its stroke cycle after a mold section A has been formed. As illustrated in FIGS. 5 and 6, the mold section A is pushed out from under the mold making machine 11 and advanced into contact with mold section B. As the ram continues to move, as shown in FIGS. 7 and 8, the entire series of cooperating mold sections are advanced along a predetermined path toward the molten metal filling station. Each time the ram 16 completes its cycle and momentarily stops, the filling vessel 20 pours molten metal into the recessed pour cup of a mold located in the mold filling station. However, the stopping point of the recessed pour cup is not always at the same precise location on the predetermined path due to such variations as changes in the compression of the mold sections 15 during formation or advancement or changes in the ram 16 cycle. Therefore, it may be necessary to reposition the vessel 20 prior to pouring to ensure that the vessel 20 is located directly over the recessed pour cup 30. Thus, the present invention provides a system for moving the vessel 20 in a direction parallel to the path of travel of the mold sections 15 so as to position the vessel at the location where the mold section 15 will stop. The system control unit 27 senses the initial movement of the ram 16 and signals the non-contact distance measuring device 40 to begin scanning for the leading edge of the recessed pour cup 30 of the mold section 15 as illustrated in FIG. 5. The measuring device 40 will scan for a predetermined interval which is normally a distance of about one-half the length of the recessed pour cup 30 or typically, about two inches. When a leading edge is detected, as shown in FIG. 6, the system control unit 27 immediately determines how far the mold section 15 has moved down the predetermined path and how far it has yet to travel to the point where the ram 16 stroke ends and the mold section 15 will stop. The system control unit 27 typically does this determination by measuring the distance the ram 16 has yet to move.

Inasmuch as the vessel 20 can be moved faster than the speed of the advancing mold sections 15, the system control unit 27, in conjunction with the vessel-moving device 25, advances the vessel 20 forward to the location the system control unit 27 has determined as being the final position of the mold section 15 when the ram 16 completes its stroke. The distance the vessel 20 is moved is equivalent to the distance the ram 16 has yet to move less one-half the length of the recessed pour cup 30 so that the vessel 20 will be centered directly over the pour cup. The vessel 20 is now positioned over the final location and the vessel 20 can pour the molten metal as shown in FIG. 8.

If the leading edge of the pour cup 30 is not detected by the time the ram 16 has necessarily completed its stroke, then the vessel 20 is moved backwards until the leading edge of the recessed pour cup 30 is detected, whereupon the vessel 20 is moved backwards an additional distance equal to one half the length of the recessed pour cup 30 in order to center the vessel 20 directly over the pour cup.

Additionally, since the non-contact distance measuring device 40 is scanning the mold section 15 and the system control unit 27 is also measuring the position of the ram 16 continuously, the measuring device 40, in conjunction with the system control unit 27, can be also employed for quality control monitoring of the length of the recessed pour cup 30 of any mold section 15 and the maximum ram 16 position. Any deviations from a predetermined standard for either of these measurements can be detected and a warning given to the operator.

Mold Filling

After the vessel 20 has been positioned directly over the pour cup 30, the vessel 20 is ready to pour molten metal into the mold cavity of the mold. The rate of pour and the volume of metal poured are important in obtaining a quality product and in avoiding molten metal waste.

The optimum pour rate is one wherein a high head level 45 in the recessed pour cup 30 is maintained. A high head level 45 causes the metal to flow into the mold cavity **15*a* at a faster rate and also reduces the possibility of contaminants entering the mold cavity 15*a*, such as slag or similar undesirable impurities floating on the surface of the metal. So long as the head level 45 is maintained at a level above that of the passageway 15*b* communicating the recessed pour cup 30 with the mold cavity 15*a*, these impurities will float above the passageway 15*b* and will be prevented from entering the mold cavity 15*a*. The pour rate also must be controlled so as to avoid sand of the mold section 15 from being washed away by the force of too high a pour rate or of too quickly changing it. The pour rate should be adjusted to decrease the head level 45 at the end of the pour in order to minimize the amount of molten metal remaining in the recessed sprue cup 30 when the mold cavity 15*a*** is filled, since any molten metal left in the cup or the passageway is waste.

Figure 9:
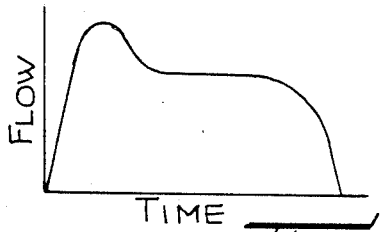
FIG. 9 is a graph illustrating the relationship of flow rate and time desirably achieved when pouring the molten metal into the mold cavity during filling.
Figure 10:
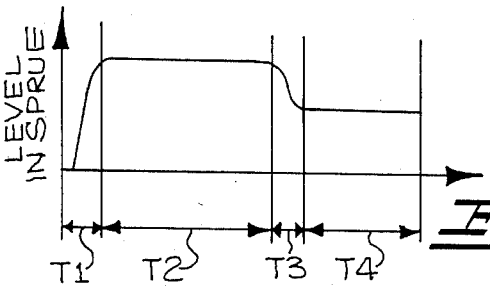
FIG. 10 is a graph illustrating the level of molten metal maintained in the recessed cup of the mold section at specific times.

The graph of FIG. 9 illustrates the optimum flow rate. The flow rate is initially high so as to quickly begin filling the mold cavity and to create a high head level in order to prevent the slag and the like from entering the mold cavity during the filling operation. The rate is then slightly reduced to a constant rate which enables the high head level 45 to be maintained during the majority of the fill period. Finally, the rate is lowered at the very end of the filling operation as the mold cavity is nearly filled and accepts the molten metal more slowly. FIG. 10 illustrates the proper head level as a function of time. During the time interval T1, the mold cavity is being filled and the head level is rising from zero to the desired high level. During the interval T2, the head level is maintained at a constant and sufficiently high level. During the interval T3, the head level is slightly reduced in preparation of the mold cavity being filled and maintained at that level during the interval T4 until the mold cavity is filled.

Figure 3:
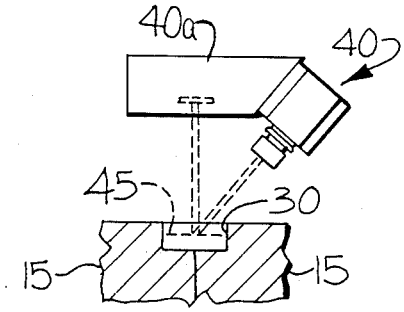
FIG. 3 is a partial side sectional view showing the non-contact distance measuring device and the molten metal level in the recessed pour cup of the mold section.
Figure 4:
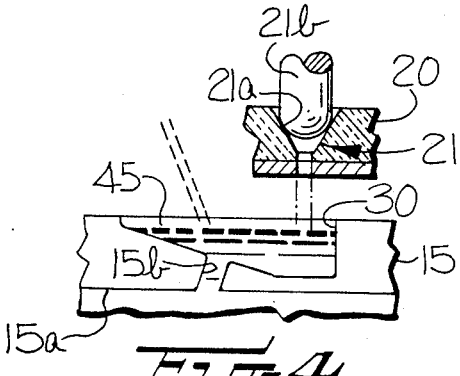
FIG. 4 is an enlarged view of the recessed pour cup of the mold section shown in FIG. 2 and illustrates the non-contact distance measuring device measuring the distance to the molten metal level during pouring.

In order to fill the mold properly, the vessel 20 must pour at a rate which follows the above-mentioned graphs of FIGS. 9 and 10. The apparatus and method of this invention accomplish this through the use of a non-contact distance measuring device 40 acting in conjunction with a system control unit 27. The subject apparatus and method are now more particularly described hereinbelow and with reference to FIGS. 2–4.

After the pour cup 30 of the mold has been positioned directly beneath the pouring vessel 20 and the advancement of the mold section S has stopped, the pour is begun. Simultaneously, the non-contact distance measuring device 40 begins determining the distance to the molten metal level or head level 45 in the recessed cup 30 and relaying this data to the control system 27. The system control unit 27, by constantly monitoring the molten metal level and having the above-mentioned graphs programmed into it, can control the operation of the valve 21 of the vessel 20 so as to maintain the desired, predetermined head level 45 in response to variations in the molten metal level. Thus, if the distance measuring device 40 senses a flucuation in this level, the system control unit 27 will adjust the valve 21 position so as to bring the level to that of the pre-programmed level. Also, when the level is changed, such as when the mold cavity is nearly filled, the distance measuring device is utilized to determine when the head level has reached the desired level. The pour is then stopped and the entire cycle of positioning and filling the mold sections is repeated.

Figure 11:
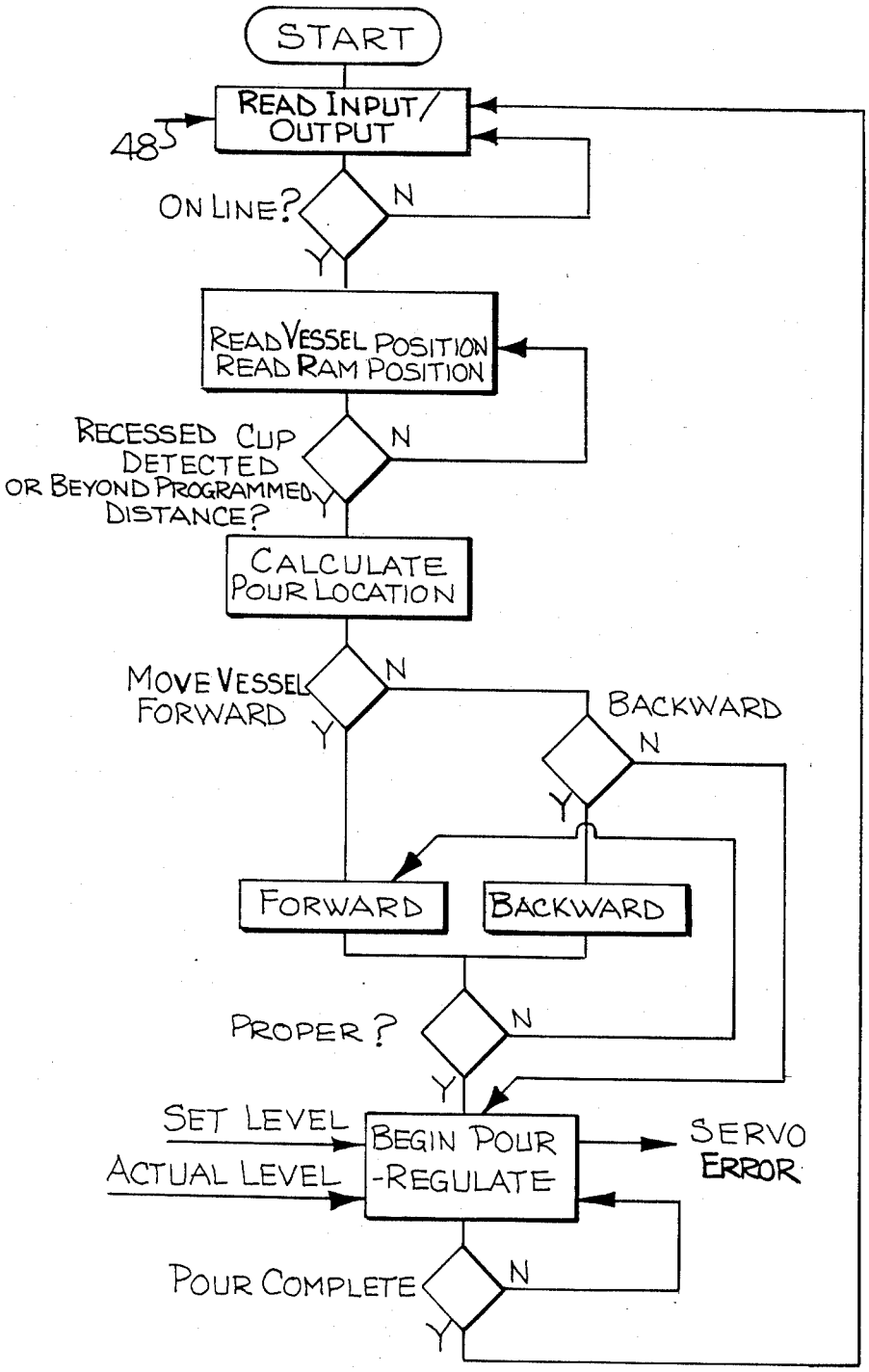
FIG. 11 is a flow chart representation of the mold section positioning and filling methods of the present invention.
Figure 13:
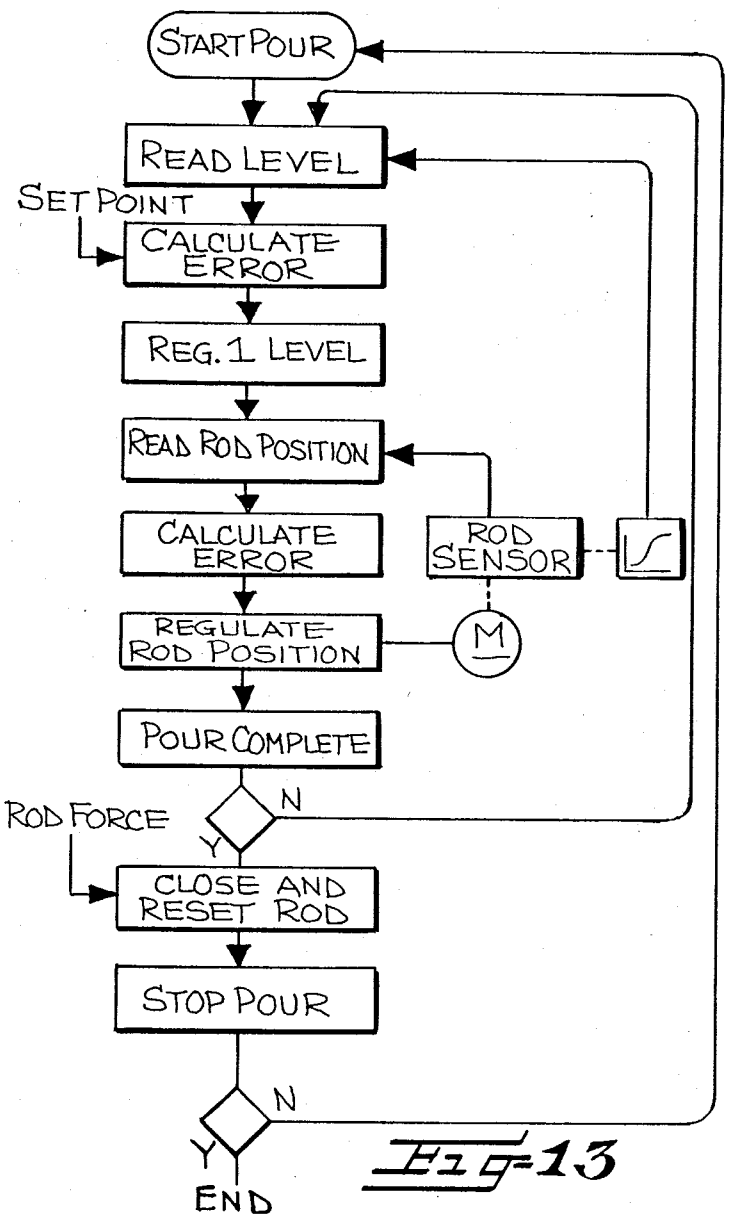
FIG. 13 is a flow chart representation of the mold filling method of the present invention.

The flowcharts of FIGS. 11 and 13 illustrate the sequence of steps carried out by the system control unit 27 in the operation of the mold section positioning and mold section filling systems. Initially, the system control unit 27 is reading input/output circuits 48 to determine whether a mold section 15 is being produced. The system control unit 27 reads the ram 16 position and the vessel 20 position and also determines from the non-contact distance measuring device whether a recessed pour cup 30 has been detected. When a recessed sprue cup 30 is detected or when the measuring device has scanned for a distance greater than a preset distance, then the unit will calculate the position where the pour vessel should be located. In so doing, the system control unit 27 determines whether it should move the vessel 20 forward or backward. If the recessed sprue cup 30 was detected, the vessel 20 is moved forward until the proper location is searched. If the recessed sprue cup 30 was not detected within the preset distance, the vessel 20 is moved backward to meet the still moving mold sections until the recessed cup is located. By going to meet the mold sections rather than waiting until they stop, the cycle time of the whole process is reduced and production is increased.

The vessel 20 is now ready to fill the mold sections 15, and the system control unit 27 to regulate the pour. The sequence is described more fully in the flow chart of FIG. 13. As the pour begins, the control system reads the level of the molten metal in the pour cup utilizing the distance measuring device 20. The system control unit 27 calculates the error in the level through a comparison of the actual measured level to the predetermined set point level of the graphs shown in FIG. 10. The actual level is adjusted to the desired level by repositioning the rod **21*b* so as to increase or decrease the pour rate. The repositioning of the rod is achieved through a servo loop which calculates the desired rod position and compares the actual rod position to the desired position until the correct position is achieved. Finally, when the system control unit 27 determines that the pour is complete, the rod 21*b* is moved to close the valve 21 and the pour is stopped. The system control unit 27** then determines whether there is another mold to be poured and if "yes", the entire positioning and filling cycle is repeated.

The foregoing embodiments are to be considered illustrative rather than restrictive of the invention, and those modifications which come within the meaning and range of equivalents of the claims are to be included therein.

That which I claim is:

1. An apparatus for controlling the filling of mold sections with molten metal comprising:

a mold making machine for forming a series of cooperating mold sections, each having a recessed cup on the upper side thereof adapted for receiving molten metal;

means for conveying the successively formed cooperatng mold sections along a predetermined path from said mold making machine to a mold pouring station;

a vessel located at said mold pouring station for dispensing molten metal into a respective mold;

means for moving said vessel along a path of travel parallel to and above said predetermined path of travel of said mold sections;

non-contact distance measuring means located above said mold sections for scanning the upper side of a mold section during its advancement to the mold pouring station to locate the recessed cup therein; and control means responsive to said non-contact distance measuring means for determining the distance that said previously scanned mold section has yet to travel to the mold pouring station and for controlling the movement of said vessel so as to position it directly over the final location of said mold section at the mold pouring station.

2. An apparatus according to claim 1 wherein said control means includes means operable in response to the locating of a recessed cup during the advancement of the mold section to the mold pouring station for moving said vessel in the same direction as the direction of movement of the mold section so as to position the vessel directly over the final location of said mold section at the mold pouring station.

3. An apparatus according to claim 1 wherein said mold making machine includes a reciprocable ram for forming a mold section with each successive stroke of the ram.

4. An apparatus according to claim 3 wherein said control means includes means for sensing the position of said ram when the recessed cup is located and to thereby determine the distance that the mold section has yet to travel to the mold filling station.

5. An apparatus according to claim 1 wherein said control means includes means operable in response to the failure of said distance measuring means to locate a recessed cup during a predetermined interval in the advancement of the mold section to the mold pouring station, and for moving said vessel the direction opposite the direction of movement of the mold section until a recessed cup is detected.

6. An apparatus for controlling the filling of mold sections with molten metal comprising:

a series of cooperating mold section, each having a recessed cup on the upper side thereof adapted for receiving molten metal, a hollow cavity in the interior thereof having a predetermined shape, an a passageway communicatively interconnecting said hollow cavity and said recess cup for directing molten metal which is received in said cup into said hollow cavity during the filling of the mold section;

means for conveying the mold sections along a predetermined path of travel to a mold pouring station;

a vessel located at said mold pouring station for dispensing molten metal into the respective mold sections; said vessel including a discharge opening for controlling the pouring of molten metal from the vessel into the respective mold sections;

distance measuring means located at said mold pouring station for measuring the distance to the molten metal level in the recessed cup of the mold section positioned at the mold pouring station; and control means connected to said distance measuring means and to said valve means for controlling the operation of said valve means in response to variations in the molten metal level in said recessed cup sensed by said distance measuring means so as to maintain a predetermined, controlled level of the molten metal in the recessed cup during the filling operation.

7. An apparatus according to claim 6 wherein said distance measuring means comprises an optical non-contact distance measuring device.

8. An apparatus according to claim 6 wherein said distance measuring means includes means for transmitting a radiant energy beam toward and into contact with the molten metal in said recessed cup and means for optically detecting the radiant energy beam on the molten metal in the recessed cup.

9. An apparatus according to claim 8 wherein said radiant energy beam is a laser.

10. An apparatus according to claim 6 wherein said control means includes means for following a programmed pour rate which varies as a function of time during the filling operation.

11. An apparatus according to claim 10 wherein said means for following a programmed pour rate is operable for pouring the molten metal initially at a relatively fast rate and thereafter at a slower rate.

12. An apparatus according to claim 10 wherein said means for following a programmed pour rate is operable for maintaining the mold metal level in the recessed cup at initially a high level and thereafter at a lower level until the end of the pour.

13. An apparatus according to claim 6 wherein said control means includes means operable during the filling operation for controlling said valve means so as to maintain the molten metal in the recessed cup at a level higher than the level where said passageway communicates with said cup so as to prevent slag and other undesirable impurities floating upon the surface of the molten metal in the recessed cup from entering said passageway during the filling operation.

14. An apparatus for controlling the filling of mold sections with molten metal comprising:

a mold making machine for forming a series of cooperating mold sections, each having a recessed cup on the upper side thereof adapted for receiving molten metal, a hollow cavity in the interior thereof having a predetermined shape, and a passageway communicatively interconnecting said hollow cavity and said recessed cup for directing molten metal which is received in said cup into said hollow cavity during the filling of the mold sections;

means for conveying the mold sections along a predetermined path of travel to a mold pouring station;

a vessel located at said mold pouring station for dispensing molten metal into the respective mold sections, said vessel including a discharge opening and valve means cooperating with the discharge opening for controlling the pouring of molten metal from the vessel into the respective mold sections;

optical, non-contact distance measuring means located at said mold pouring station and operable for measuring the distance to the recessed cup of the mold sections positioned at the mold pouring station; and control means operable during the mold pouring operation and responsive to the measured distance to the recessed cup for controlling said valve means and for maintaining the molten metal in the recessed cup at a higher level than the level where said passageway communicates with said cup so as to prevent slag and other undesirable impurities floating upon the surface of the molten metal in the recessed cup from entering said passageway during the filling operation.

15. An apparatus according to claim 14 wherein said distance measuring means includes means for transmitting a radiant energy beam toward and into contact with the molten metal in said recessed cup and means for optically detecting the radiant energy beam on the molten metal in the recessed cup.

16. An apparatus according to claim 14 additionally including means for moving said vessel along a path of travel parallel to and above said predetermind path of travel of said mold sections, and wherein said control means also includes means operation during the conveying of a mold section to the mold pouring station and responsive to said distance measuring means sensing the presence or absence of a recessed cup therebeneath for controlling movement of said vessel to ensure the proper positioning of the vessel with respect to the recessed cup prior to filling of the mold section.

17. An apparatus for controlling the filling of mold sections with molten metal comprising:

a mold making machine including a reciprocable ram for forming a mold section with each successive stroke of the ram;

a series of cooperating mold sections formed by said mold making machine, said mold sections each including a recessed cup on the upper side thereof adapted for receiving molten metal, a hollow cavity in the interior thereof having a predetermind shape, and a passageway communicatively interconnecting said hollow cavity and said recessed cup for directing molten metal which is received in said cup into said hollow cavity during the filling of the mold section;

means for conveying the successively formed cooperating molds along a predetermned path from said mold making machine to a mold pouring station with each successive stroke of said ram;

a vessel located at said mold pouring station for dispensing molten metal into the respective mold sections and including a discharge opening and valve means cooperating with the discharge opening for controlling the pouring of molten metal from the vessel into the respective mold sections;

means for moving said vessel along a path of travel parallel to and above said predetermined path of travel of said mold sections;

non-contact distance measuring means located above said mold sections and oriented towards said recessed cup for scanning the upper side of the mold sectios during the advancement thereof to the pouring station to locate the recessed cup therein and also operable during the filling of the mold section for measuring the distance to the molten metal level in said recessed cup; and control means cooperating with said distance measuring means and operable during advancement of the mold sections to the mold pouring station for determining the distance that the previously scanned mold section has yet to travel to the mold pouring station and for controlling the movement of said vessel so as to position it directly over the final location of said mold section at the mold pouring station, and also operable during the filling of the mold section for controlling the operation of said valve means in response to variations in the molten metal level sensed by said distance measuring means so as to maintain a predetermined, controlled level of the molten metal during the filling operation.

18. An apparatus according to claim 17 wherein said control means includes means operable in response to the locating of a recessed cup during the advancement of the mold sections to the mold pouring station for moving said vessel in the same direction as the direction of movement of the mold sections so as to position the vessel directly over the final location of said mold section at the mold pouring station.

19. An apparatus according to claim 17 wherein said control means includes means operable in response to the failure of said distance measuring means to locate a recessed cup during a predetermined interval in the advancement of the mold sections to the mold pouring station, for moving said vessel the direction opposite the direction of movement of the mold sections until a recessed cup is detected.

20. An apparatus according to claim 17 wherein said control means includes means operable during the filling of the mold section for controlling said valve means so as to maintain the molten metal in the recessed cup at a level higher than the level where said passageway communicates with said cup so as to prevent slag and other undesirable impurities floating upon the surface of the molten metal in the recessed cup from entering said passageway during the filling operation.

21. An apparatus according to claim 17 wherein said distance measuring means includes means for transmitting a radiant energy beam toward and into contact with the molten metal in said recessed cup and means for optically detecting the reflected radiant energy beam from the molten metal level in the recessed cup.

22. An apparatus according to claim 20 wherein said control means includes means operable during the filling of the mold section for controlling the rate of pour in accordance with a programmed pour rate which varies as a function of time during the filling operation.

23. A method for controlling the filling of mold sections with molten metal comprising:

forming a series of cooperating mold sections, each mold section having a recessed cup on the upper side thereof adapted for receiving molten metal;

conveying the successively formed cooperating mold sections along a predetermined path of travel to a mold pouring station;

scanning the upper side of the mold sections during the advancement of the mold sections to the mold filling station so as to locate the recessed cup therein;

determining the distance that the previously scanned mold section has yet to travel to the mold pouring station; and moving the dispensing vessel based upon the determination of the distance that the mold section has yet to travel so as to position the vessel directly over the final location of the mold section at the mold pouring station.

24. A method according to claim 23 wherein said step of moving the dispensing vessel includes moving the vessel in the same direction as the direction of movement of the mold sections so as to position the vessel directly over the final location of the mold section at the mold pouring station.

25. A method according to claim 23 wherein said step of scanning during the advancement of the mold sections is done for a predetermined interval and wherein said step of moving the vessel includes the step, performed in response to the failure to locate the recessed cup during the interval, of moving the vessel in the direction opposite the direction of movement of the mold sections until a recessed cup is detected.

26. A method according to claim 23 wherein said step of determining the distance the mold section has yet to travel includes determining the distance a reciprocable ram, utilized for forming the cooperating mold sections and for conveying the mold sections along said predetermined path of travel, has yet to move.

27. A method for controlling the filling of mold sections with molten metal comprising:

forming a series of cooperating mold sections, said mold sections each including a recessed cup on the upper side thereof adapted for receiving molten metal, a hollow cavity in the interior thereof having a predetermined shape, and a passageway communicatively interconnecting the hollow cavity and the recessed cup;

conveying said series of cooperating mold sections along a predetermined path and successively positioning each recessed cup beneath a vessel containing molten metal; and pouring molten metal from the vessel into the respective mold section while measuring the distance to the molten metal level in the recessed cup of the mold section and while controlling the rate of pour of the molten metal from the vessel in response to the measured distance so as to maintain a predetermined controlled level of the molten metal during the pouring operation.

28. A method according to claim 27 wherein the step of controlling the rate of pour of the molten metal comprises maintaining the molten metal in the recessed cup at a level higher than the level where the passageway communicates with the cup so as to prevent slag and other undesirable impurities floating upon the surface of the molten metal in the recessed cup from entering the passageway during the filling operation.

29. A method according to claim 27 wherein the step of measuring the distance to the molten metal level comprises directing a radiant energy beam toward and into contact with the molten metal in the recessed cup and optically detecting the radiant energy beam on the molten metal in the recessed cup.

30. A method for controlling the filling of mold sections with molten metal comprising:

forming a series of cooperating mold sections, the mold sections each including a recessed cup on the upper side thereof adapted for receiving molten metal, a hollow cavity in the interior thereof having a predetermined shape, and a passageway communicatively interconnecting the hollow cavity and the recessed cup;

conveying the series of cooperating mold sections along a predetermined path and successively positioning each recessed cup beneath a vessel containing molten metal; and pouring molten metal from the vessel into the respective mold section while measuring the distance to the molten metal level in the recessed cup of the mold section by transmitting a radiant energy beam toward and into contact with the molten metal in said recessed cup and optically detecting the reflected radiant energy beam from the molten metal level in the recessed cup and while controlling the rate of pour of the molten metal so as to maintain a predetermined controlled level, the molten metal initially being poured at a relatively fast rate and thereafter at a slower rate thereby maintaining the molten metal in the recessed cup at a higher level than the level where the passageway communicates with the cup so as to prevent slag and other undesirable impurities floating upon the surface of the molten metal in the recessed cup from entering the passageway during the filling operation.

31. A method for controlling the filling of mold sections with molten metal comprising:

forming a series of cooperating mold sections with each successive stroke of a ram of a mold making machine, the molds including a recessed cup on the upper side thereof adapted for receiving molten metal, a hollow cavity in the interior thereof having a predetermined shape, and a passageway communicatively interconnecting the hollow cavity and the recessed cup;

conveying the successively formed cooperating mold sectinos along a predetermined path of travel to a mold pouring station;

scanning the upper side of the mold sections during the advancement of the mold sections to the mold pouring station to locate the recessed cup therein;

moving a molten metal dispensing vessel based upon the determination of the distance that the previously scanned mold section has yet to travel so as to position the vessel directly over the final location of the mold section at the mold pouring station; and pouring molten metal from the vessel into the respective mold section while measuring the distance to the molten metal level in the recessed cup of the mold section and while controlling the rate of pour of the molten metal from the vessel in response to the measured distance so as to maintain a predetermined controlled level of the molten metal during the pouring operation.

32. A method according to claim 31 wherein said step of moving the vessel includes moving the vessel in the same direction as the direction of movement of the mold sections so as to position the vessel directly over the final location of the mold section at the mold pouring station.

33. A method according to claim 31 wherein said step of scanning during the advancement of the mold sections is done for a predetermined interval, and said step of moving the vessel includes the step, performed in response to the failure to locate the recessed cup during the interval, of moving the vessel in the direction opposite the direction of movement of the mold sections until a recessed cup is detected.

34. A method according to claim 31 wherein said step of determining the distance the mold section has yet to travel includes determining the distance a reciprocable ram, utilized for forming said cooperating mold sections and for conveying the mold sections along said predetermined path of travel, has yet to move.

35. A method according to claim 31 wherein the step of controlling the rate of pour of the molten metal comprises maintaining the molten metal in the recessed cup at a level higher than the level where the passageway communicates with the cup so as to prevent slag and other undesirable impurities floating upon the surface of the molten metal in the recessed cup from entering the passageway during the filling operation.

36. A method according to claim 31 wherein the step of measuring the distance to the molten metal level comprises transmitting a radiant energy beam toward and into contact with the molten metal in said recessed cup and optically detecting the radiant energy beam on the molten metal in the recessed cup.

* * * * *

UNITED STATES PATENT AND TRADEMARK OFFICE

CERTIFICATE OF CORRECTION

PATENT NO. : 4,724,894

DATED : February 16, 1988

INVENTOR(S) : Eric J. Sjodahl

It is certified that error appears in the above-identified patent and that said Letters Patent is hereby corrected as shown below:

Column 7, line 68, "cooperatng" should be -- cooperating --.

Column 8, line 47, "section" should be -- sections --.

Column 8, line 50, "an" should be -- and --.

Column 10, line 16, "predetermind" should be -- predetermined --.

Column 10, line 18, "operation" should be -- operable --.

Column 10, line 34, "predetermind" should be -- predetermined --.

Column 10, line 41, "predetermned" should be -- predetermined --.

Column 10, line 56, "sectios" should be -- sections --.

In the drawings:

In Figure 9, the legend on the y axis should read -- FLOW --.

UNITED STATES PATENT AND TRADEMARK OFFICE

CERTIFICATE OF CORRECTION

PATENT NO. : 4,724,894

DATED : February 16, 1988

INVENTOR(S) : Eric J. Sjodahl

It is certified that error appears in the above-identified patent and that said Letters Patent is hereby corrected as shown below:

In Figure 11, a portion of the text was obliterated and should read as follows -- Recessed Cup Detected or Beyond Programmed Distance? --.

Signed and Sealed this

Second Day of August, 1988

*Attest:*

*Attesting Officer*

DONALD J. QUIGG

*Commissioner of Patents and Trademarks*